US006099704A

United States Patent [19]

Bacquet et al.

[11] Patent Number: 6,099,704

[45] **Date of Patent: *Aug. 8, 2000**

[54] ASBESTOS-FREE CATHODIC ELEMENT SUITABLE FOR ELECTROLYSIS OF SODIUM CHLORIDE SOLUTION

[75] Inventors: Gérard Bacquet, Houilles; Frédéric Kuntzburger, Saint-Symphorien, both of France

[73] Assignee: Chloralp, Le Pont de Claix, France

[ * ] Notice: This patent is subject to a terminal disclaimer.

[21] Appl. No.: 09/101,010

[22] PCT Filed: Dec. 27, 1996

[86] PCT No.: PCT/FR96/02091

§ 371 Date: Oct. 6, 1998

§ 102(e) Date: Oct. 6, 1998

[87] PCT Pub. No.: WO97/24474

PCT Pub. Date: Jul. 10, 1997

[30] Foreign Application Priority Data

Dec. 29, 1995 [FR] France ..... 95 15712

[51] Int. Cl.[7] ..... C25B 11/04

[52] U.S. Cl. ..... 204/291; 204/282; 204/283; 204/290 R; 204/294; 252/502; 252/503; 252/500; 252/519.33; 252/520.3; 427/122; 427/126.1; 427/180; 427/201; 427/245; 427/295; 427/352; 427/372.2; 427/304

[58] Field of Search ..... 204/291, 282, 204/283, 290 R, 294; 162/138; 252/502, 503, 500, 519.33, 520.3; 427/122, 126.1, 180, 201, 245, 295, 352, 372.2, 304

[56] References Cited

U.S. PATENT DOCUMENTS 5,584,977 12/1996 Bachot et al. ..... 204/291
5,626,905 5/1997 Bachot et al. ..... 427/122

FOREIGN PATENT DOCUMENTS 0 630 870 12/1994 European Pat. Off. .

*Primary Examiner*—Bruce F. Bell
*Attorney, Agent, or Firm*—Burns, Doane, Swecker & Mathis, L.L.P.

[57] ABSTRACT

This invention covers a cathodic element free from asbestos fibres that can be obtained by deposition after filtration through a porous medium of an aqueous suspension comprising electrically conductive fibres, at least one cationic polymer, at least one electocatalytic agent, at least one pore-forming agent and at least one binder selected from among the fluoropolymers. The invention also covers a method for preparing such a cathodic element.

23 Claims, No Drawings

ASBESTOS-FREE CATHODIC ELEMENT SUITABLE FOR ELECTROLYSIS OF SODIUM CHLORIDE SOLUTION

The subject-matter of the present invention is a cathode component devoid of asbestos fibres, its process of preparation and its use in the production of alkali metal hydroxide solution.

The materials used for the preparation of the cathode component of an electrolysis cell must correspond to several specific characteristics. Thus, they must exhibit a low electrical resistivity, compatible with the operation, at an acceptable energy level, of the electrolyser equipped with such a cathode component. Furthermore, they must also make it possible to obtain a component which is low in thickness while conferring on the said component a high specific surface which can exceed several square meters.

Such cathode components are generally obtained by depositing, by filtration through a porous support, a dispersion of the materials used. One of the difficulties of this type of process is to be able to control the amount of product effectively retained at the surface of the porous support, the latter exhibiting a level of opening or diameters of holes which are large with respect to the size of the materials used. In addition, the sheet must exhibit controlled and reproducible characteristics of porosity and of homogeneity, in terms of thickness of the sheet and of distribution of these constituents, if cathode components which are unusable or poor in performance are not to be obtained.

One of the first generations of cathode component consisted in depositing a suspension comprising carbon fibres, asbestos fibres, a fluorinated polymer binding the fibres, an electrocatalytic agent and a pore-forming agent.

The advantage of this type of cathode component is now limited because of anticipated new regulations relating to asbestos fibres. This is because the toxicity of these fibres is now recognized and there is a tendency to no longer allow the use of such a material.

Furthermore, it has been found that the long-term stability of asbestos fibres in the electrolytic medium comprising a concentrated base and a salt was to be improved, so as to limit the replacement, regarded as excessively frequent, of the cathode components.

Firstly, provision was made to dispense purely and simply with the asbestos fibres in the fibrous suspension. However, the resulting sheet proved to be unusable in industrial-scale electrolysis because it was not possible to efficiently control the thickness and the porosity of the said sheet. In addition, its cohesion with the cathode was not satisfactory either.

In the light of such results, one suggestion consisted in substituting the asbestos fibres by organic fibres of the fluorinated polymer type. However, the performances of the cathode component were not satisfactory either. This is because the porosity and the thickness could not always be controlled, essentially after the stage of consolidation of the said sheet (or sintering).

Given these facts, a novel type of asbestos-free cathode component has been provided in which these fibres were replaced by a mixture of organic fibres, of the fluorinated polymer type, and of inorganic fibres, such as, in particular, titanate fibres.

Just like the preceding generation of cathode component based on asbestos fibres, this novel composition of the fibrous sheet makes it possible to obtain highly satisfactory properties in electrolysis of sodium chloride solutions.

However, the disadvantage of this latter sheet composition is its high cost, due mainly to the organic and inorganic fibres, which represent a not insignificant part of the composition.

The aim of the present invention is to provide a fibrous sheet composition devoid of asbestos and of organic and inorganic fibres, such as those which have just been mentioned.

Thus, the invention relates to a cathode component devoid of asbestos fibres which is capable of being obtained by deposition, by filtration through a porous support, of an aqueous suspension comprising electrically conducting fibres, at least one cationic polymer, at least one electrocatalytic agent, at least one pore-forming agent and at least one binder chosen from fluorinated polymers.

The invention likewise relates to a process for the preparation of such a cathode component which consists in implementing the following stages:

[a] an aqueous suspension is prepared comprising electrically conducting fibres, at least one cationic polymer, at least one electrocatalytic agent, at least one binder chosen from fluorinated polymers and at least one pore-forming agent;

[b] the said suspension is deposited on a porous support by filtration under programmed vacuum;

[c] the sheet thus obtained is dewatered and dried, optionally;

[d] the resulting combination is sintered at a temperature greater than or equal to the melting or softening temperature of the binder;

[e] the pore-forming agent is removed, if necessary, by treatment carried out before the use of the cathode component or during its use.

It has been found, completely unexpectedly, that it was possible to obtain cathode components with a level of performance comparable with that of the components described above and known to a person skilled in the art, the obligation being removed to employ asbestos fibres, organic fibres based on fluorinated polymer and inorganic fibres based on titanate, in particular. This could not be anticipated from the fact that, previously, the tendency was always to retain compounds with a fibrous nature, in addition to the conducting fibres.

It has likewise been found, in contrast to what is accepted in the field, that it is possible to obtain stable sheets after heat treatment without the use of inorganic fillers or fibres previously regarded as essential.

In addition, the present invention makes it possible to obtain a suspension which it is possible to filter vertically, that is to say, under industrial conditions. This characteristic was not obvious either because the formulation of the suspension according to the invention is devoid of thickening agent of the xanthan gum type, previously regarded as essential in order to obtain this result.

However, other advantages and characteristics will become more clearly apparent on reading the description and examples which will follow.

As was mentioned previously, the cathode component according to the invention is capable of being obtained by deposition by filtration, through a porous support, of a dispersion comprising electrically conducting fibres, at least one cationic polymer, at least one electrocatalytic agent, at least one pore-forming agent and at least one binder.

Generally and advantageously, this dispersion is aqueous.

The electrically conducting fibres can be intrinsically conducting fibres or else fibres treated so as to render them such.

According to a specific embodiment of the invention, intrinsically conducting fibres, such as, in particular, carbon fibres or graphite fibres, are employed.

More particularly, these fibres are provided in the form of filaments with a diameter generally of less than 1 mm and more particularly between $10^{-3}$ and 0.1 mm and with a length greater than 0.5 mm and more especially between 1 and 20 mm.

Furthermore, the conducting fibres preferably exhibit a monodisperse length distribution, that is to say a distribution such that the length of at least 80% and advantageously of at least 90% of the fibres corresponds to the mean length to within about ±10%.

As regards the binder, the latter is chosen from fluorinated polymers.

"Fluorinated polymers" is understood to mean homopolymers or copolymers derived at least partly from olefinic monomers substituted by fluorine atoms, or substituted by a combination of fluorine atoms and of at least one of the chlorine, bromine or iodine atoms, per monomer.

Examples of fluorinated homopolymers or copolymers can comprise polymers and copolymers derived from tetrafluoroethylene, hexafluoropropylene, chlorotrifluoroethylene or bromotrifluoroethylene.

Such polymers can also comprise up to 75 molar % of units derived from other ethylenically unsaturated monomers comprising at least as many fluorine atoms as carbon atoms, such as, for example, vinylidene (di)fluoride or vinyl perfluoroalkyl ethers, such as perfluoroalkoxyethylene.

This fluorinated polymer, or binder, is more particularly provided in the form of an aqueous dispersion comprising 30 to 80% by weight of dry polymer, the particle size of which is between 0.1 and 5 $\mu$m and preferably between 0.1 and 1 $\mu$m.

According to a specific embodiment of the invention, the fluorinated polymer is polytetrafluoroethylene.

It is possible to employ, as electrocatalytic agent, any type of metal known in the field for activating the electrolysis reaction.

However, according to a first specific alternative form of the invention, use is made of a Raney metal, such as, preferably, nickel, or else of a precursor of this Raney metal, consisting in fact of an alloy based on the said metal in combination with another which can easily be removed. More particularly, it is an alloy comprising aluminium which can be leached, for example by a basic treatment. This type of electrocatalytic agent has been described in particular in European Patent EP 296,076, to which reference may be made on this subject.

According to a second alternative form, use may be made, as electrocatalytic agent, of particles comprising a ruthenium, platinum, iridium or palladium oxide or a mixture of these oxides.

Mixture is understood to mean particles comprising, in themselves, a mixture of oxides but also particles, based on one metal oxide, mixed with other particles comprising a different oxide. Very clearly, the intermediate combinations between these two possibilities are entirely envisageable.

The said agent can in addition be provided in the form of particles composed of an electrically conducting support comprising a coating in the form of ruthenium, platinum, iridium or palladium oxide; these oxides being alone or as a mixture in the sense which has just been explained.

It would not be departing from the scope of the present invention to combine these two alternative forms, that is to say particles based on oxide or coated with an oxide.

The electrocatalytic agent according to the invention is preferably provided in the form of a coating of a support, such as, in particular, iron, cobalt, nickel, Raney iron, Raney cobalt, Raney nickel, elements from groups IVA and VA of the periodic classification, carbon or graphite. Here and throughout the description which will follow, the peridoic classification of the elements to which reference is made is that published in the supplement to the Bulletin de la Société Chimique de France (No. 1, 1966).

This type of electrocatalytic agent is described in particular in French Patent Application FR 94 01702.

It should be noted that, here again, the combination of the two types of electrocatalytic agents described previously is possible.

The aqueous dispersion additionally comprises at least one pore-forming agent.

All compounds are suitable insofar as they can be removed by chemical or heat treatment, for example.

Thus, according to a first alternative form of the invention, use is made of silica-based derivatives. These compounds are particularly advantageous because they show virtually no effect in weakening the electrically conducting microporous material and form networks with the polymer binding the fibres, when this polymer is employed in the form of a latex. Furthermore, these compounds are removed by leaching with a base, such as sodium hydroxide.

"Silica-based derivatives" is understood to mean, according to the invention, precipitated silicas and combustion or pyrogenic silicas. They more particularly exhibit a BET specific surface of between 100 $m^2/g$ and 300 $m^2/g$ and/or a particle size, evaluated using a Coulter® counter, between 1 and 50 $\mu$m and preferably between 1 and 15 $\mu$m.

It is also possible to envisage using, instead of the abovementioned pore-forming agents or as a mixture with these, nanoparticulate systems which are thermally destroyed, more particularly during the operation of sintering the cathode component, such as nanolatices or latices with a size of less than 100 $\mu$m.

Finally, one of the essential constituents of the dispersion employed according to the invention is composed of a cationic polymer.

Mention may be made, among suitable cationic polymers, of two categories of polymer, organic polymers and inorganic polymers, which can be used alone or as a mixture.

As example of polymers of the first category, synthetic polymers chosen from epichlorohydrin, polyimines, polyacrylamides or polyacrylamines are polymers capable of forming part of the composition of the suspension employed in the invention. Polymers of natural origin, such as in particular cationic starches or cationic guars, are suitable compounds in the invention.

Mention may be made, among inorganic polymers, without implied limitation, of clays, bentonites, aluminium sulphate or aluminium polychloride.

According to a preferred embodiment, the suspension according to the invention comprises at least one polymer of the polyacrylamine type, sold in particular under the name Floerger® by the company Floerger, of the cationic starch type, such as cationic starches which are soluble with heating (Hi-Cat® cationic starches, sold by the company Roquette) and cationic starches which are soluble when cold, or of the cationic guar type, sold under the trade name Meypro® by the company Meyhall; it being possible for these polymers to be present alone or as a mixture.

According to a particularly advantageous embodiment of the present invention, when a nanoparticulate system is employed, it is combined with at least one cationic polymer. In such a case, use is more particularly made of a cationic polymer chosen from epichlorohydrin, polyimines, polyacrylamides or cationic starches.

The suspension employed in the process according to the invention can, in addition, comprise additional compounds.

Thus, according to a first alternative form of the invention, the suspension comprises, if appropriate, a fibrous material. More particularly, the fibrous material is chosen from cellulose-based fibres, cellulose-based fibres to which a positive ionic charge has been given, glass fibres or calcium silicate fibres.

Mention may be made, as positively charged cellulose fibres, of Becofloc® fibres or, as calcium silicate fibres, of Promaxon® fibres.

It should be noted that additives can form part of the composition of the suspension according to the invention.

Thus, the suspension comprises, in addition to the above-mentioned constituent components, at least one surface-active agent.

Use is more particularly made, as surfactant, of non-ionic compounds, such as ethoxylated alcohols or fluorocarbon compounds containing functionalized groups, generally exhibiting carbon chains comprising 6 to 20 carbon atoms. Use is preferably made of ethoxylated alcohols chosen from ethoxylated alkylphenols, such as, in particular, octoxynols.

The suspension according to the invention is thus deposited on a porous support. This porous support is generally electrically conducting. It should be noted that it would not be departing from the scope of the present invention to deposit the suspension on a support which is not electrically conducting, so as to create a fibrous sheet which would subsequently be combined with an electrically conducting porous support.

The porous support is more particularly composed of cloths or grids for which the mesh size, perforations or porosity can be between 20 $\mu$m and 5 mm. The porous support can exhibit one or more flat or cylindrical surfaces, commonly known as "thimble", exhibiting an open surface.

The conducting porous support is composed in particular of iron, of nickel or of any material treated so as to render it even less sensitive to the corrosiveness of the medium, such as, for example, iron on which nickel would have been deposited.

According to a very advantageous alternative form of the invention, the fibrous sheet deposited on the electrically conducting porous support is combined with a microporous diaphragm.

A first embodiment consists in depositing the diaphragm on the fibrous sheet. This type of process is known to a person skilled in the art and has in particular formed the subject of the following patents: [lacuna]

According to a second embodiment of this alternative form, the diaphragm is not deposited on the fibrous sheet but is arranged separately, so as to separate the anode and cathode compartments.

Such diaphragms are commercially available and in particular are based on fibres of the ceramic type or Teflon.

According to a second alternative form of the invention, the cathode, comprising the fibrous sheet deposited on an electrically conducting support, is combined with a membrane.

Mention may be made, as examples of membranes suitable for the process according to the invention, of perfluorosulphonic membranes of the Nafion type (sold by the company Du Pont) or of perfluorinated membranes comprising carboxyl functional groups (series 890 or Fx-50, sold by the company Asahi Glass). Moreover, it is possible to use bilayer membranes comprising, on one face, sulphonic groups and, on the other, carboxyl groups.

The preparation process capable of being employed for the preparation of the cathode component according to the invention will now be described:

[a] an aqueous suspension is prepared comprising electrically conducting fibres, at least one cationic polymer, at least one electrocatalytic agent, at least one binder chosen from fluorinated polymers and at least one pore-forming agent;

[b] the said suspension is deposited on a porous support by filtration under programmed vacuum;

[c] the sheet thus obtained is dewatered and dried, optionally;

[d] the resulting combination is sintered at a temperature greater than or equal to the melting or softening temperature of the binder;

[e] the pore-forming agent is removed, if necessary, by treatment carried out before or during the use of the cathode.

Thus, in a first stage [a], an aqueous suspension based on the components which have just been described is prepared.

The content of conducting fibres is determined so that the overall resistivity of the final fibrous sheet is less than or equal to 0.4 Ω.cm.

The suspension more particularly comprises 20 to 100 parts by weight of conducting fibres. According to a specific alternative form of the invention, the content of conducting fibres is between 50 and 90 parts by weight.

As regards the binder, its content is between 10 and 60 parts by weight on a dry basis.

The amount of catalytic agent can vary within wide limits.

More particularly, the content of this compound in the aqueous suspension is between 20 and 200 parts by weight. More particularly, the content is between 60 and 120 parts by weight.

The amount of pore-forming agent forming part of the composition of the dispersion itself also varies within a wide range.

In the case where the pore-forming agent can be removed by chemical treatment, as is the case with silica-based derivatives in particular, this content is generally between 30 and 200 parts. More particularly, the amount of pore-forming agent forming part of the composition of the suspension is between 30 and 100 parts by weight.

In the case where the pore-forming agent can be removed thermally, such as for nanoparticulate systems of the type of latices with a size of less than 100 $\mu$m or of nanolatices, the amount of this type of compound is more particularly between 10 and 200 parts by weight.

It is possible to envisage a combination of these two latter possibilities. In the latter case, the amount of pore-forming agents corresponding to a mixture of agents which can be removed chemically and thermally is more particularly between 30 and 200 parts by weight.

The aqueous suspension according to the invention additionally comprises at least one cationic polymer. The content of this polymer in the suspension is such that the measurement of the turbidity of the supernatant liquid after the suspension has settled is greater than or equal to 50 and preferably greater than or equal to 75. It should be noted that the same measurement, carried out with pure water, gives a value of 100. The turbidity is measured by transmission at 630 nm on a turbidimeter of Methrom 662 photometer® type.

Furthermore, another criterion relating to the choice of the content of cationic polymer depends on the viscosity conferred on the suspension. The latter should preferably be such that it does not cause excessive difficulty in filtering the suspension.

In the more specific case of cationic starch, the content varies between 10 and 80 parts by weight on a dry basis.

Preferably, the content of cationic polymer varies between 20 and 40 parts by weight on a dry basis.

The content of fibrous material, other than cellulose fibres, which fibres may or may not be positively charged, is controlled by the same conditions as the abovementioned conducting fibres. Thus, their content is such that the overall resistivity of the final fibrous sheet is less than or equal to 0.4 Ω.cm.

In the specific case where the suspension comprises cellulose-based fibres, which may or may not be positively charged, as fibrous material, their content is at most 60 parts by weight on a dry basis. According to a specific alternative form, the content of cellulose fibres is between 10 and 40 parts by weight.

The amount of surfactant forming part of the composition of the suspension generally varies from 0.5 to 5 parts by weight, although it is entirely possible to envisage amounts outside this range.

The aqueous suspension thus prepared is generally left to stand for at least 1 hour.

In a following stage [b], the suspension obtained above is deposited on a porous support which is preferably electrically conducting.

The sheet is deposited on the porous support by filtration under programmed vacuum. The latter is produced in a way known per se and can be produced, continuously or stepwise, to a final negative pressure of $1.5\times10^3$ to $5\times10^4$ Pa.

In an entirely advantageous way, the suspension obtained can be filtered vertically, which represents a particularly advantageous benefit for operation on an industrial scale. Very clearly, it is entirely possible to envisage depositing the suspension by horizontal filtration.

Once this sheet has been deposited, the latter is dewatered by maintaining the vacuum for a few moments and then optionally dried in the air at a temperature of between room temperature and 150° C.

The sheet is then sintered by heating at a temperature greater than or equal to the melting temperature of the fluorinated polymer. During this sintering stage, a portion of the constituents of the, mixture from which the fibrous sheet is formed is generally degraded thermally. This is in particular the case when the pore-forming agent is at least partly composed of the nanoparticulate system mentioned previously.

When the pore-forming agent is at least partly composed of agents such as silica derivatives, a stage of removal of the pore-forming agent, in particular by means of an aqueous alkali metal hydroxide solution, is subsequently carried out. It should be noted that the removal of this pore-forming agent can be carried out not only "in situ", that is to say during the first moments of use of the cathode, but also before use of the electrically conducting microporous material. The latter possibility exhibits the advantage of minimizing contamination of the electrolytic medium.

In the case where the cathode employed in the process according to the invention comprises a combined diaphragm in the sense that the diaphragm is deposited directly on the fibrous sheet, the stages [a] to [d] are carried out as indicated above. The fibrous sheet of the diaphragm is then deposited according to methods known in the field. Thus, the suspension comprising the constituent components of the fibrous sheet of the diaphragm, as described in particular in Patents EP 412,917 and EP 642,602, can be deposited either on the sintered or non-sintered fibrous sheet, on which will or will not have been carried out a treatment for removal of the pore-forming agent, or not. Once deposition has been carried out, the combination is subsequently dewatered and optionally dried. A stage of sintering at a temperature of greater than or equal to the melting or softening temperature of the binder present in the fibrous sheet of the diaphragm is then carried out, before removing the pore-forming agent by a treatment carried out before use of the cathode or during use of the latter.

Concrete but non-limiting examples will now be presented.

EXAMPLES 1

These examples illustrate the preparation of a fibrous sheet comprising the cationic polymer and cellulose fibres.

A suspension is prepared from the following components:

- deionized water, the amount of which is calculated in order to obtain approximately 4 liters of suspension and a solids content of approximately 3% by weight,
- 35 g of polytetrafluoroethylene in the latex form with a solids content of 60%,
- 20 g of Becofloc® cellulose fibres (Begerow),
- 20 or 40 g of Hi-Cat® 165 cationic starch (Roquette),
- 100 g or 200 g of precipitated silica in the form of particles with a mean particle size of 3 mm and with a BET specific surface of 250 $m^2 .g^{-1}$,
- 70 g of carbon fibres, the diameter of which is approximately 10 mm and the mean length of which is 1.5 mm,
- 3.3 g of Triton X 100® from the company Rohm and Haas,
- 121 g of Raney nickel in the 10 mm powder form (Ni 20, sold by the company Procatalyse).

The starch and then the cellulose fibres are introduced with stirring into 4 liters of deionized water.

After stirring, the silica, the PTFE latex, the Triton X 100®, the carbon fibres and finally the Raney nickel are then added.

After having been stirred, the suspension obtained is filtered under vacuum through a woven and laminated iron mesh of "Gantois" type steel, the opening of which is 2 mm and the diameter of the wires of which is 1 mm, the deposition surface area being 1.21 $dm^2$.

The negative pressure is thus established and increases by $50\times10^2$ Pa per minute to reach a negative pressure shown in the table hereinbelow. This maximum negative pressure is maintained for approximately 15 minutes.

The combination is then dried and then strengthened by melting the fluorinated polymer at 350° C.

The silica is removed "in situ" in the electrolyser by dissolution in alkaline medium, in particular during the first hours of electrolysis.

The results are combined in Table 1 hereinbelow:

| Tests | 1 | 2 | 3 |
|---|---|---|---|
| Composition (parts by weight | | | |
| cellulose | 20 | 20 | 20 |
| starch | 20 | 20 | 40 |
| silica | 200 | 200 | 200 |
| Suspended mass | 300 | 300 | 300 |
| Results | | | |
| wgt. dep. ($kg/m^2$) | 0.44 | 0.37 | 0.33 |
| vacuum ($10^2$ Pa) | 320 | 435 | 386 |
| level retained (%) | 55 | 46 | 55 |

Test 1 was carried out one hour after the preparation of the aqueous suspension.

Tests 2 and 3 were carried out 5 and 4 days respectively after the preparation of the suspension.

Tests 1 and 2 show that the storage of the suspension has little influence on the filtration conditions for the latter and instead promotes an improvement in the final vacuum for the same weight deposited. The feasibility of the operation is thereby increased.

EXAMPLES 2

These examples illustrate the preparation of a fibrous sheet comprising the cationic polymer without cellulose fibres.

The preparation is carried out as in the preceding example, except that the amounts of starch and of cellulose fibres are different.

The results and the contents are combined in Table 2 hereinbelow:

| Tests | 1 | 2 |
|---|---|---|
| Composition (parts by weight | | |
| cellulose | 0 | 0 |
| starch | 40 | 40 |
| silica | 200 | 200 |
| Suspended mass | 300 | 300 |
| Results | | |
| wgt. dep. ($kg/m^2$) | 0.35 | 0.4 |
| vacuum ($10^2$ Pa) | 250 | 350 |
| level retained (%) | 45 | 50 |

What is claimed is:

1. Cathode component devoid of asbestos fibres obtained by deposition on a porous support by filtration through the porous support of an aqueous suspension comprising electrically conducting fibres, at least one cationic polymer, at least one electrocatalytic agent, at least one pore-forming agent and at least one binder chosen from fluorinated polymers.

2. Cathode component according to claim 1, wherein the electrically conducting fibres are carbon fibres or graphite fibres.

3. Cathode component according to claim 1, wherein the conducting fibres exhibit a monodisperse length distribution.

4. Cathode component according to claim 1, wherein the electrocatalytic agent is a Raney metal or a precursor of this metal, or particles comprising a ruthenium, platinum, iridium or palladium oxide or a mixture of these oxides, or particles comprising an electrically conducting support exhibiting a coating in the form of ruthenium, platinum, iridium or palladium oxide or a mixture of these oxides.

5. Cathode component according to claim 1, wherein the pore-forming agent can be removed by chemical or heat treatment.

6. Cathode component according to claim 5, wherein the pore-forming agent comprises silica-based derivatives or nanoparticulate systems that are thermally destroyed.

7. Cathode component according to claim 6, wherein the nanoparticulate systems are nanolatices or latices with a size of less than 100 $\mu$m.

8. Cathode component according to claim 1, wherein the cationic polymer is chosen from organic polymers comprising synthetic polymers or polymers of natural origin.

9. Cathode component according to claim 8, wherein the synthetic polymers are epichlorohydrin, polyimines, polyacrylamides or polyacrylamines.

10. Cathode component according to claim 8, wherein the polymers of natural origin are cationic starches or cationic guars.

11. Cathode component according to claim 1, wherein the cationic polymer is chosen from inorganic polymers.

12. Cathode component according to claim 11, wherein the inorganic polymers are clays, bentonites, aluminium sulphate or aluminium polychloride.

13. Cathode component according to claim 1, wherein the suspension additionally comprises a fibrous material chosen from cellulose-based fibres, cellulose-based fibres to which a positive ionic charge has been given, glass fibres or calcium silicate fibres.

14. Cathode component according to claim 1, wherein said cathode component is combined with a diaphragm.

15. Cathode component according to claim 1, wherein said cathode component is combined with a membrane.

16. Process for the preparation of a cathode component according to claim 1, comprising:

preparing an aqueous suspension comprising electrically conducting fibres, at least one cationic polymer, at least one electrocatalytic agent, at least one binder chosen from fluorinated polymers and at least one pore-forming agent;

depositing said suspension on a porous support by filtration under programmed vacuum to obtain a sheet;

optionally dewatering and drying the sheet;

sintering the resulting sheet at a temperature greater than or equal to the melting or softening temperature of the binder;

removing the pore-forming agent, if necessary, by treatment before or during the use of the cathode component.

17. Process according to claim 16, wherein the aqueous suspension comprises 20 to 100 parts by weight of electrically conducting fibres.

18. Process according to claim 16, wherein the aqueous suspension comprises 10 to 60 parts by weight of binder.

19. Process according to claim 16, wherein the aqueous suspension comprises 30 to 200 parts by weight of pore-forming agent when the latter can be removed by chemical treatment, or 10 to 200 parts by weight of pore-forming agent when the latter can be removed thermally, or 30 to 200 parts by weight of pore-forming agent when the pore-forming agent is a mixture of agents which can be removed chemically and thermally.

20. Process according to claim 16, wherein the aqueous suspension comprises 20 to 200 parts by weight of electrocatalytic agent.

21. Process according to claim 16, wherein the aqueous suspension comprises at least one cationic polymer in an amount such that the measurement of the turbidity of the supernatant liquid after the suspension has settled is greater than or equal to 50; or the turbidity measurement when carried out with pure water gives a value of 100.

22. Process according to claim 16, wherein the aqueous suspension comprises at most 60 parts by weight on a dry basis of cellulose-based fibres, which fibres may or may not be positively charged.

23. Process according to claim 22, wherein the aqueous suspension comprises 10 to 40 parts by weight on a dry basis of cellulose-based fibres.

* * * * *